US005823807A

United States Patent [19]

Yamasaki et al.

[11] Patent Number: 5,823,807

[45] Date of Patent: Oct. 20, 1998

[54] CONNECTOR ASSEMBLY WITH MECHANISM FOR CONFIRMATION OF FITTING OF CONNECTOR HOUSING AND METHOD OF ATTACHING CONNECTOR HOUSING

[75] Inventors: Masashi Yamasaki, Hiroshima; Kouichi Ogawa, Shiga; Katsuhiko Nishimura, Shiga; Takashi Fujiwara, Shiga; Hironori Yanagimoto, Shiga; Tomoo Hamamoto, Tokyo, all of Japan

[73] Assignees: The Furukawa Electric Co., Ltd., Tokyo; Ohmi Electric Wire Co., Ltd., Inukami, both of Japan

[21] Appl. No.: 668,333

[22] Filed: Jun. 25, 1996

[30] Foreign Application Priority Data

Jun. 27, 1995 [JP] Japan ..... 7-161215

[51] Int. Cl.[6] ..... H01R 13/62

[52] U.S. Cl. ..... 439/157; 439/310; 439/347; 439/489; 439/557

[58] Field of Search ..... 439/157, 489, 439/310, 372, 347, 557

[56] References Cited

U.S. PATENT DOCUMENTS

| | | | |
|---|---|---|---|
| 5,073,125 | 12/1991 | Hashiguchi et al. | 439/310 |
| 5,252,089 | 10/1993 | Hatagishi et al. | 439/310 |
| 5,433,619 | 7/1995 | Maejima | 439/157 |

FOREIGN PATENT DOCUMENTS

| | | | |
|---|---|---|---|
| 0 090 502 A2 | 10/1983 | European Pat. Off. . | |
| 0 625 809 A1 | 11/1994 | European Pat. Off. . | |
| 0 669 679 A2 | 8/1995 | European Pat. Off. . | |
| 37 09 461 | 10/1987 | Germany . | |
| 3910117 | 9/1990 | Germany | 439/310 |
| 44 31 879 | 3/1995 | Germany . | |
| 5-1178 | 8/1993 | Japan . | |

*Primary Examiner*—Gary F. Paumen
*Assistant Examiner*—Brian J. Biggi
*Attorney, Agent, or Firm*—Nikaido, Marmelstein, Murray & Oram LLP

[57] ABSTRACT

Provision of a connector assembly which enables a half-fitted state to be reliably prevented and further enables a fitting force to be reduced. A connector assembly having a first housing in which an end of at least one first signal line is attached, a second housing in which an end of at least one second line to be connected to the end of the first signal line is attached and which fits with a fitting opening of the first housing, and a plate shaped fitting detection pin which is inserted from a detection insertion slot formed at a side of the first housing so as to pass through an approximate center axis of the first housing. The second housing is formed with a detection pin recess which allows the insertion of the fitting detection pin in a state where the second housing is fitted in the fitting opening of the first housing. The facing inner walls of the second housing constituting the detection pin recess are formed with projecting guide ribs. Cam grooves, having slanted walls engaging with the guide ribs are formed at the two surfaces of the fitting detection pin.

11 Claims, 11 Drawing Sheets

CONNECTOR ASSEMBLY WITH MECHANISM FOR CONFIRMATION OF FITTING OF CONNECTOR HOUSING AND METHOD OF ATTACHING CONNECTOR HOUSING

BACKGROUND OF THE INVENTION

1. Field of the Invention

The present invention relates to a connector assembly for connecting cables, more particularly, a connector assembly with a mechanism for confirmation of its fitting which enables confirmation, visually or at the time of insertion into the panel hole, of the complete connection of connector housings and enables a reduction of the fitting force and to a method of attachment of the same.

2. Description of the Related Art

A connector assembly used for connecting part of wire harness of a vehicle such as an automobile, for example, must ensure complete fitting of a female housing and a male housing, both constituting the connector assembly, from the viewpoint of safety etc. Further, the increase in the number of the signal lines including power lines etc., connected by connector assemblies has been accompanied by an increase in the fitting force required for connecting connector housings and a large possibility of an incomplete fitting state.

Further, a connector assembly for a wire harness for the door in a vehicle, in particular, requires waterproofness. Since the resistance is increased by the amount for compressing the waterproofing seal, there may often be happened incomplete fitting of connector assemblies.

To reduce the fitting force between connector housings, Japanese Unexamined Utility Model Publication (Kokai) No. 5-1178 discloses a connector assembly having a mechanism. In the connector assembly of this publication, a cam plate is attached to a side of one housing in a detachable manner. A cam groove provided in the cam plate engages with a cam pin provided on the other housing. The engagement between the cam groove and the cam pin reduces the fitting force between the housings.

In the connector assembly disclosed in this publication, however, since the cam plate is attached to a side of the housing, the fitting force acting on the housing due to the engagement of the cam groove and the cam pin acts offset from the center axis of the housing, so one housing is pushed into the other housing in an offset manner. As a result, a twisting force acts between the housings and it suffers from the disadvantage that the two housings cannot be fitted well. Further, it suffers from the disadvantage of that a reduction of the fitting force can not be achieved.

Further in the connector assembly described in this publication, no consideration was given to ways to affix it in a waterproof state to the panel hole of the panel, such as the door panel of a vehicle.

To reduce the fitting force of a connector with a large number of terminals, it may be considered to divide it into a number of connector assemblies with fewer terminals and perform the connection using the same. In this case, however, the amount of work for fitting the housings increases and there may be occurred error in wiring.

In the field of vehicles such as automobiles in particular, the trend is toward a greater number of signal lines of the connector assembly to be fitted. Further, it is necessary to reliably prevent an incomplete fitting state.

SUMMARY OF THE INVENTION

An object of the present invention is to provide a connector assembly which enables reliable prevention of an incomplete fitting state and further enables a reduction of the fitting force.

According to the present invention there is provided with a connector assembly including: a first housing in which an end of at least one first signal line is attached, a second housing in which an end of at least one second line to be connected to the end of the first signal line is attached and which fits with a fitting opening of the first housing, and a plate shaped fitting detection pin which is inserted into a detection insertion hole formed at a side of the first housing so as to pass an approximate center axis of the first housing, the second housing being formed with a detection pin recess which allows the insertion of the fitting detection pin in a state where the second housing is fitted in the fitting opening of the first housing, at least one of the inner walls of the facing inner walls of the second housing constituting the detection pin recess being formed with a projecting guide rib, a cam groove having a slanted wall constituted so that in the state where the fitting detection pin is inserted into the detection insertion slot, the front end of the guide rib engages and a force acts in a direction pushing the second housing into the fitting opening of the first housing along with the movement in the direction of insertion of the fitting detection pin, being formed at the surface of the fitting detection pin facing the guide rib.

Preferably, the two inner walls of the facing inner walls of the second housing constituting the detection pin recess are formed with projecting guide ribs and the two surfaces of the fitting detection pin are formed with cam grooves having slanted walls each constituted so that in the state where the fitting detection pin is inserted into the detection insertion opening, the front end of the guide rib engages and a force acts in a direction pushing the second housing into the fitting opening of the first housing along with the movement in the direction of insertion of the fitting detection pin.

Preferably, the two sides of the detection insertion slot formed at a side of the first housing are formed with panel fixing lock pieces for attaching and affixing the first housing in a panel hole formed in a panel.

Preferably, the rear end of the fitting detection pin is formed with a pullout preventing lock piece for preventing the fitting detection pin from being pulled out from the detection insertion opening in a state where the fitting detection pin is fully inserted into the detection insertion slot.

Preferably, the fitting opening of the first housing is formed with a fitting projection which projects out along the approximate center axis, the second housing is formed with a fitting recess which fits with the fitting projection and intersects the detection pin recess, and the fitting projection is formed with a through hole through which the fitting detection pin is inserted.

The method of attachment of a connector assembly according to the present invention is comprised of steps: temporarily inserting a plate shaped fitting detection pin into a detection insertion opening formed at a side of a first housing in which the end of at least one first signal line is attached so as to pass through an approximate center axis of the first housing; loosely inserting from the second signal line side of a panel hole formed in a panel a second housing in which the end of at least one second signal line to be connected with the end of the first signal line is attached; inserting at the first signal line side of the panel hole of the panel the second housing into a fitting opening of the first housing in which the fitting detection pin has been temporarily inserted and engaging a guide rib formed on an inner wall facing a detection pin recess formed in the second housing with a cam groove having a slanted wall formed in the fitting detection pin; fully inserting the fitting detection pin into the detection insertion opening of the first housing and using the engagement between the cam grooves and the guide pins to push the second housing into the fitting opening of the first housing to prevent half-fitting (incomplete-fitting) of the first housing and the second housing; and inserting into the panel hole of the panel the first housing and the second housing in a state with the fitting detection pin fully inserted for a complete fitting and affixing the outer periphery of the first housing to the panel hole.

Preferably, the panel fixing lock pieces formed on the outer periphery of the first housing are used to affix the first housing to the panel hole of the panel in a detachable manner.

Preferably, when inserting the fitting detection pin into the detection insertion opening of the first housing, a pullout preventing lock piece formed at the rear end of the fitting detection pin is used to fully insert the fitting detection pin in a manner so as to prevent its being pulled out.

Preferably, a waterproofing grommet is attached in advance to the outer periphery of the rear end of the first housing and the first signal lines and, when attaching the first housing to the panel opening of the panel, the end of the grommet is pushed against the panel wall to create a waterproof construction.

BRIEF DESCRIPTION OF THE DRAWINGS

The above and other objects and features of the present invention will be apparently more in detail with reference to the accompanying drawings, in which.

DESCRIPTION OF THE PREFERRED EMBODIMENTS

Preferred embodiments of a connector assembly and method of attachment of the present invention will be described in detail.

Figure 1:
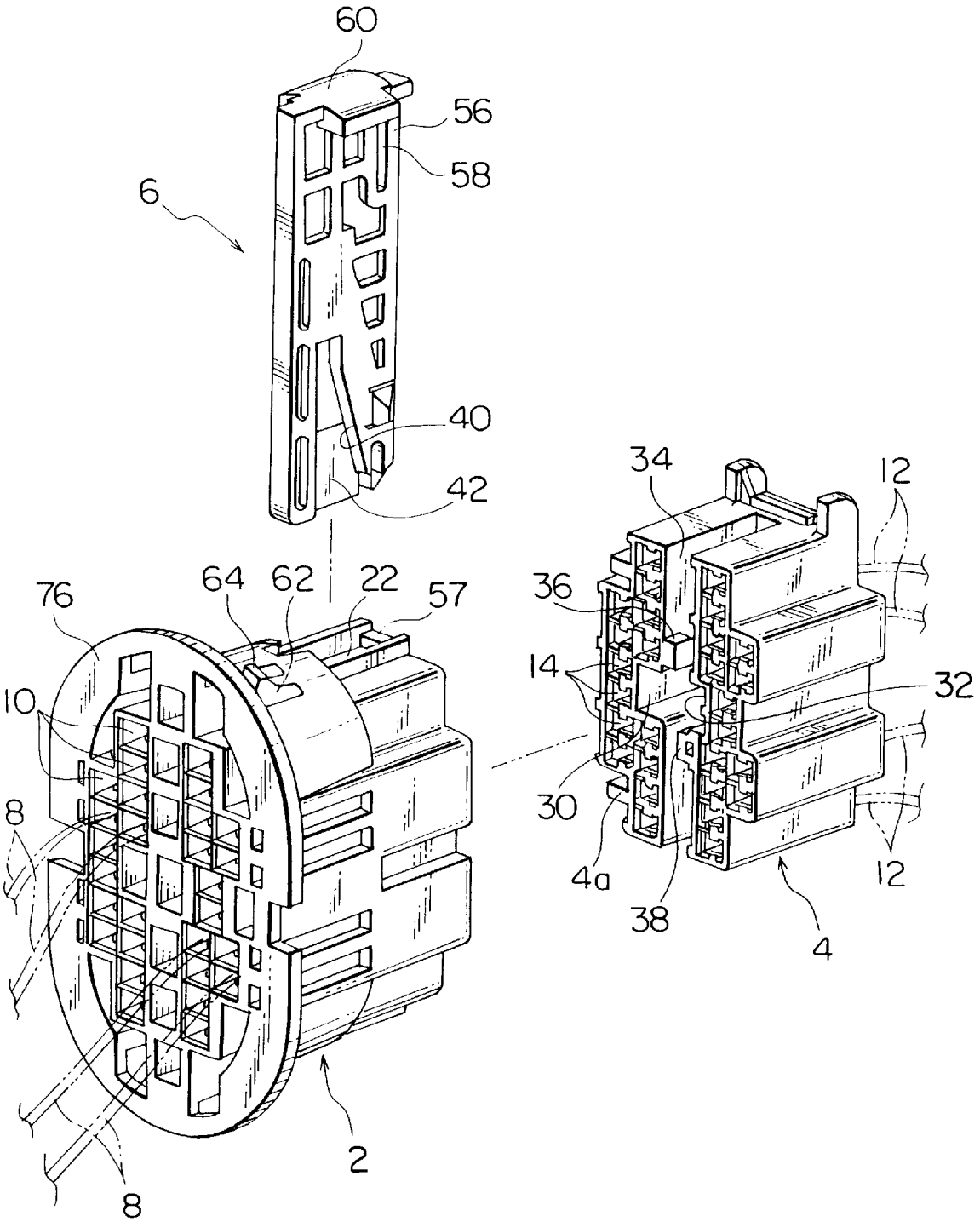
FIG. 1 is a perspective view of a disassembled connector assembly according to an embodiment of the present invention.

As shown in FIG. 1, a connector assembly according to an embodiment of the present invention has a first housing 2, a second housing 4, and a fitting detection pin 6. These first housing 2, second housing 4, and fitting detection pin 6 may be formed for example from synthetic resin.

Figure 2:
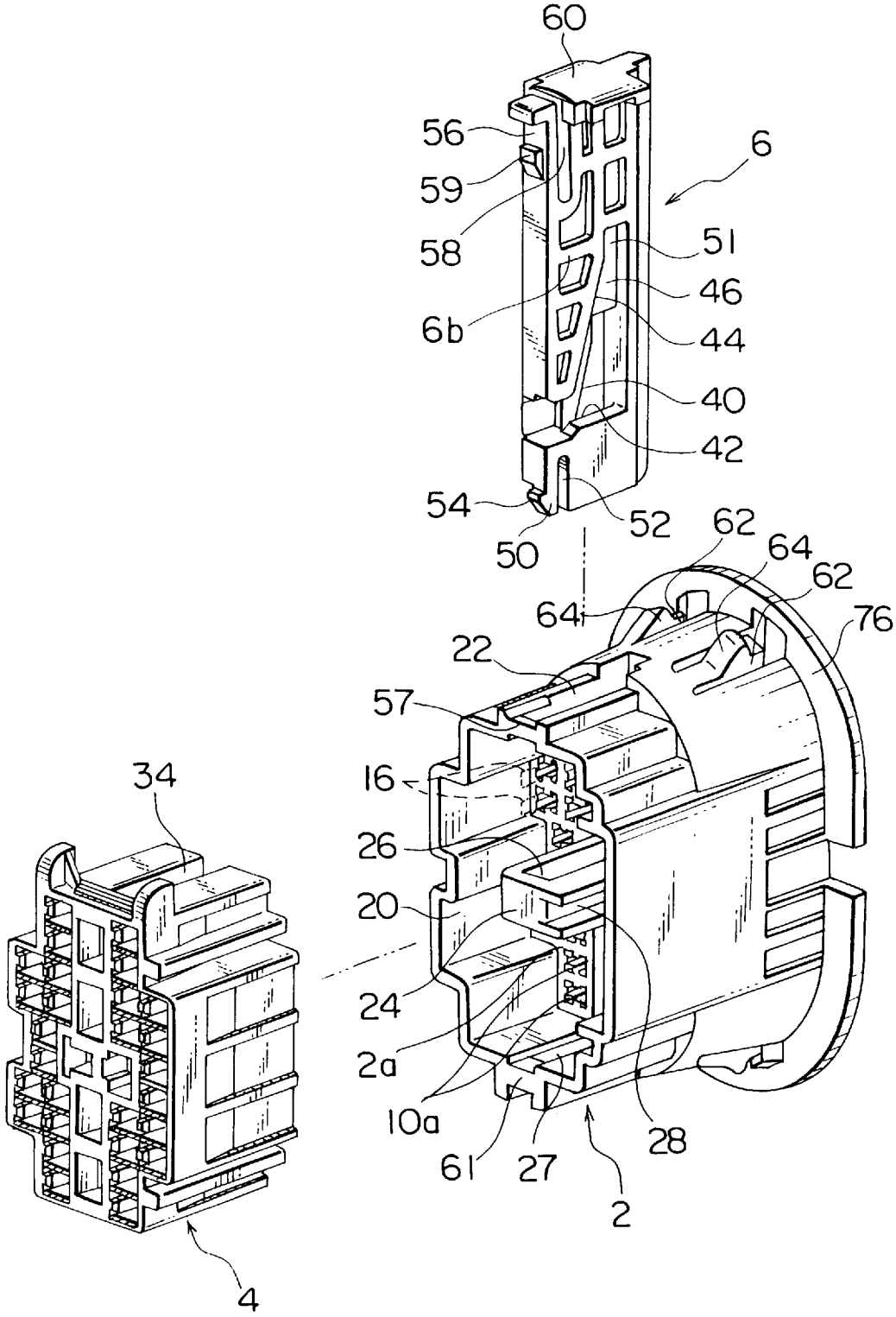
FIG. 2 is a perspective view of a first housing shown in FIG. 1.

The front end of the first housing 2 has formed in it, as shown in FIG. 2, a fitting opening (hole) 20 for fitting with the front end of the second housing 4. As shown in FIG. 1, the rear end of the first housing 2 is formed with a flange 76. The flange 76 is formed with a plurality of terminal attachment holes 10 passing through the first housing in the axial direction. The terminal attachment holes 10 enable the ends of first lead lines 8, each formed by electric-conductive metal such as copper and an insulation coating, serving as the first signal lines of the present invention to be attached.

In the embodiment, the signal lines attached to the first and second housings of the connector are not particularly limited, but for example one may be a lead line having a male terminal and the other a lead line having a female terminal. The signal line, in addition to a lead line, may be an optical fiber or other signal line.

Figure 8:
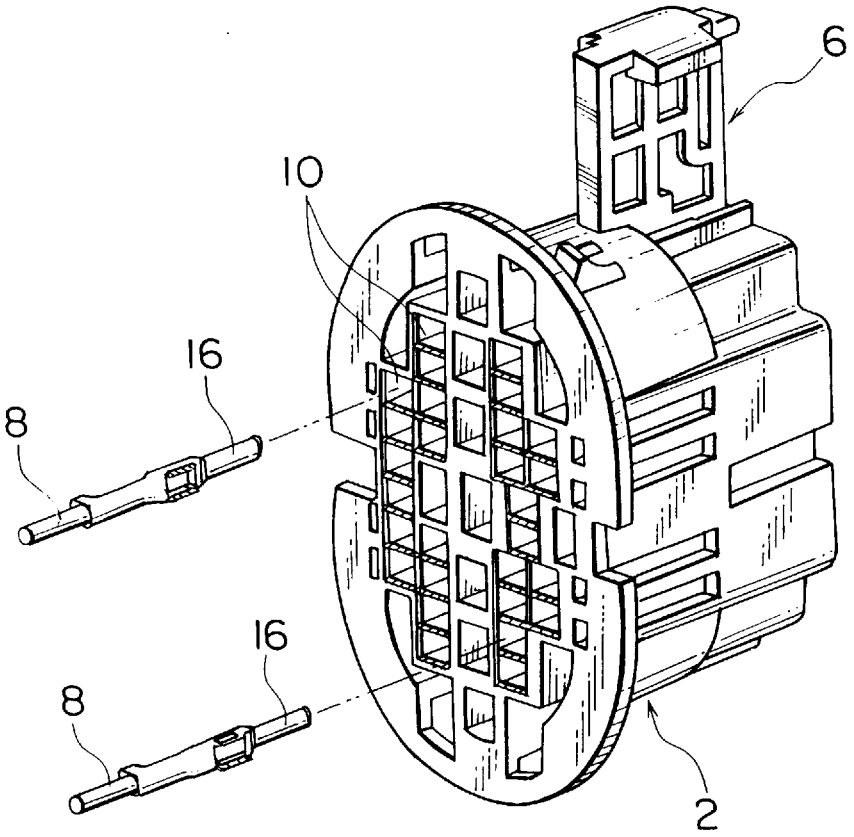
FIG. 8 is a perspective view of the method of attachment of the male terminals to the first housing.

In the embodiment, the front ends of the first lead lines 8, as shown in FIG. 8, have male terminals 16 connected to them. The male terminals 16 are designed to project out at the openings 10*a* (FIG. 2) of the first terminal attachment holes 10, in which the ends of the first lead lines 8 are inserted, from the first fitting and surface 2*a* (FIG. 2) formed at the bottom of the fitting opening 20 of the first housing 2. The layout of the first lead lines 8 with respect to the first terminal attachment holes 10 may be freely changed.

Figure 3:
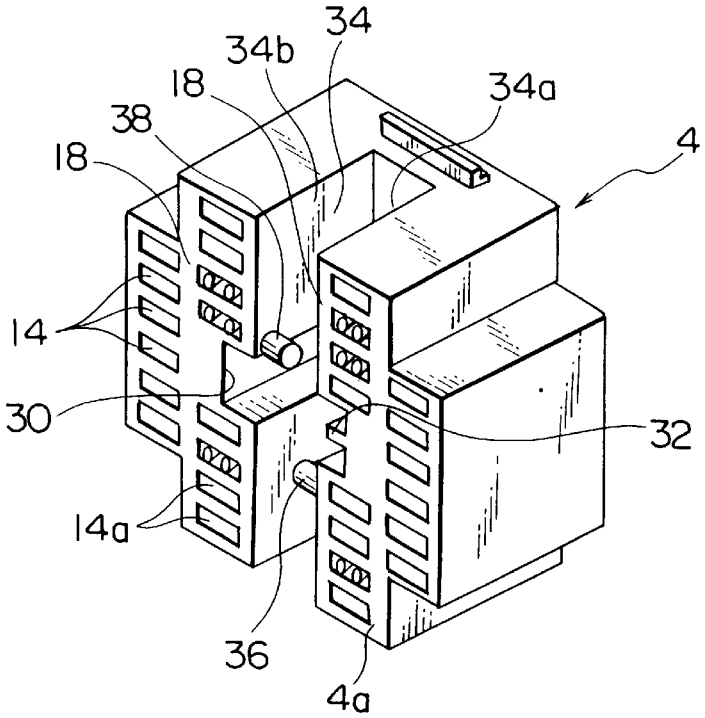
FIG. 3 is a perspective view of a second housing shown in FIG. 1.

Corresponding to the layout of the first lead lines 8 attached in the first terminal attachment holes 10, as shown in FIG. 1, the front ends of second lead lines 12 serving as the second signal lines are attached from the rear end of the second housing 4 to a plurality of second terminal attachment holes 14 formed passing through the second housing 4 in the axial direction. In this embodiment, the front ends of the second lead lines 12 have connected to them female terminals 18 shown in FIGS. 3 and 9. In FIG. 3, the female terminals 18 are disposed at openings (holes) 14*a* of the second fitting surface 4*a* formed at the front surface of the second housing 4 at positions corresponding to the male terminals 16 shown in FIG. 2.

The fitting hole 20 of the first housing 2 shown in FIG. 2 has regularly fitted in it the front end of the second housing 4 shown in FIG. 3. When the fitting surfaces 2*a* and 4*a* are in uniform contact with each other, the male terminals 16 and female terminals 18 are reliably connected.

As shown in FIGS. 1 and 2, one side (top) of the outer periphery of the first housing 2 has formed in it a detection insertion slot 22 extending in the axial direction. This detection insertion slot 22 may have inserted in it the front end of the plate shaped fitting detection pin 6 shown in FIGS. 1 and 4.

As shown in FIG. 2, in the present embodiment, the fitting opening 20 of the first housing 2 is formed with a fitting projection 24 projecting out along the approximate center axis. This fitting projection 24 is designed to fit with a fitting recess 30 formed along the approximate center axis of the front end of the second housing 4, as shown in FIG. 3. From the perspective of preventing upside-down attachment of the second housing with the first housing 2 shown in FIG. 2 and the perspective of ensuring smooth fitting, one side wall of the fitting recess 30 of the second housing 4, as shown in FIG. 3 is formed with a guide projection 32 in the axial direction. One side of the fitting projection 24 shown in FIG.

2 is formed with a guide recess 28. The guide projection 32 can move along the guide recess 28.

As shown in FIG. 2, the fitting projection 24 is formed with a through hole 26 extending in the axial direction corresponding to the detection insertion opening 22. The through hole 26 has inserted in it the front end of the fitting detection pin 6 shown in FIGS. 1 and 4. As described later, in the state where the fitting detection pin 6 shown in FIGS. 1 and 4 is fully inserted from the detection insertion hole 22 shown in FIG. 2, the front end of the fitting detection pin 6 is inserted into a front end insertion opening 27 formed at the opposite side of the detection insertion slot 22 in the periphery of the first housing 2.

As shown in FIGS. 1 and 3, the second housing 4 is formed with a detection pin recess 34 for passing the fitting detection pin 6 in a manner to pass through approximate center axis of the second housing 4 and intersect the fitting recess 30. The width between the inner walls 34*a* and 34*b* constituting the fitting recess 30 is slightly larger than the thickness of the plate shaped fitting detection pin 6 and about the same as the widths of the detection insertion slot 22, through hole 26, and front end insertion slot 27 shown in FIG. 2.

As shown in FIG. 3, at one inner wall 34*a* of the detection pin recess 34 at the front end of the housing 4 just under the fitting recess 30 is formed a first columnar guide rib 36. At the other inner wall 34*b* of the detection pin recess 34 at the front end of the housing 4 just above the fitting recess 30 is formed a second columnar guide rib 38. The heights of these guide ribs 36 and 38 are preferably not more than one-half the width of the detection pin recess 34. The outer diameters of the guide ribs 36 and 38 are approximately equal.

Figure 4:
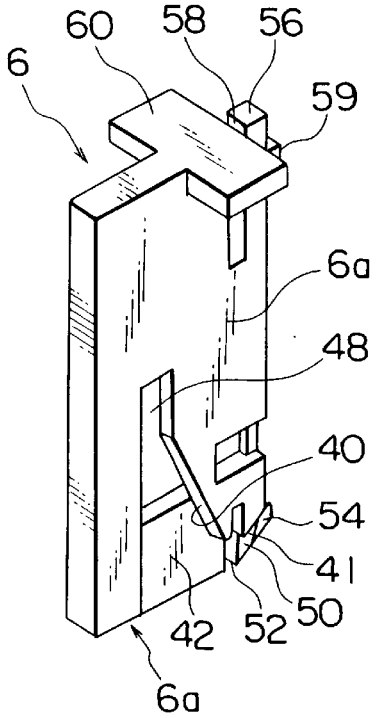
FIG. 4 is a perspective view of a fitting detection pin shown in FIG. 1.
Figure 5:
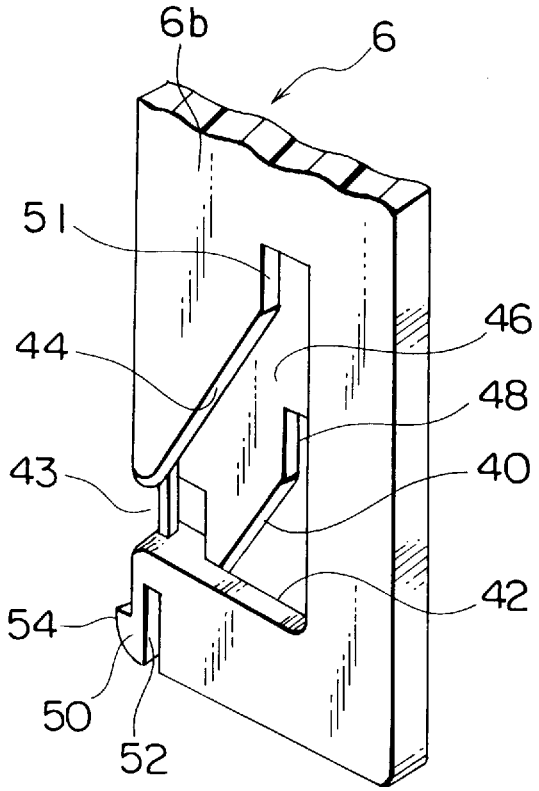
FIG. 5 is a perspective view of principal parts seen from the opposite side of the fitting detection pin shown in FIG. 4.
Figure 12:
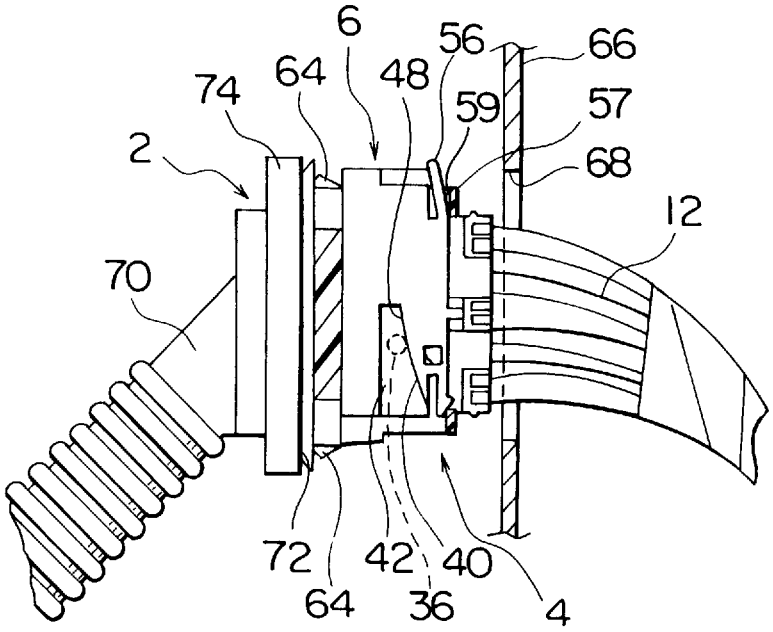
FIG. 12 is a partially sectional side view showing the method of use of the connector assembly shown in FIG. 1.
Figure 13:
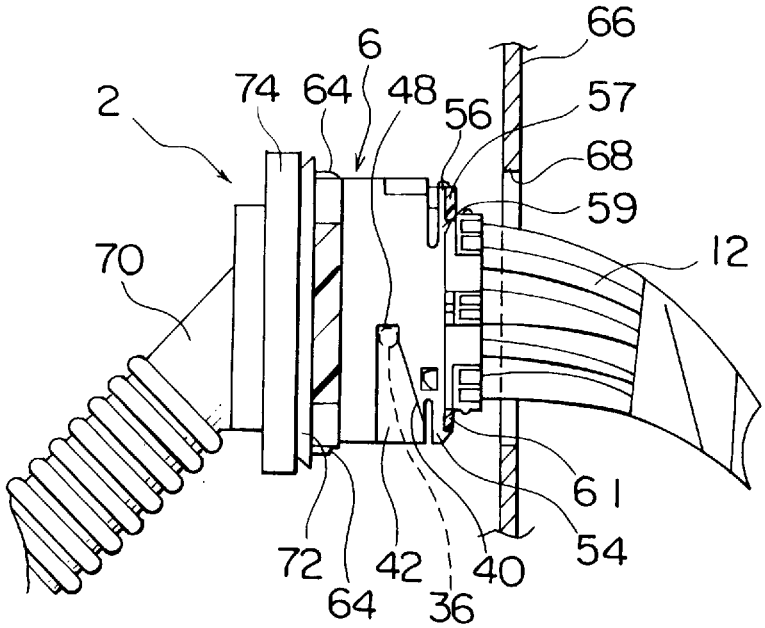
FIG. 13 is a partially sectional side view showing the method of use of the connector assembly shown in FIG. 1.

The guide ribs 36 and 38 are designed to engage with first and second slanted walls 40 and 44 of first and second cam grooves 42 and 46 formed at the two sides 6*a* and 6*b* of the plate shaped fitting detection pin 6 shown in FIGS. 4 and 5. The states of engagement are shown in FIGS. 12 and 13. Note, in FIGS. 12 and 13, only the relationship between the first guide rib 36 and the first cam groove 42 is shown. The relationship between the second guide rib 38 and the second cam groove 46 is similar.

As shown in FIG. 4, the first cam groove 42 is formed at the front end of one surface 6*a* of the fitting detection pin 6. The depth of the first cam groove 42 is about half of the thickness of the plate shaped fitting detection pin 6. The first columnar guide rib 38 shown in FIG. 3 enters into the first cam groove 42 from an inlet 41 formed at the front end of the fitting detection pin 6 shown in FIG. 4, rides up along the slanted wall 40, and drops into a lock groove 48. The second columnar guide rib 38 shown in FIG. 3 enters into the second cam groove 46 from an inlet 43 formed at the front end of the fitting detection pin 6 shown in FIG. 5, rides up along the slanted wall 44, and drops into a lock groove 51. As shown in FIG. 5, the first cam groove 42, compared with the second cam groove 46, is formed further to the front end of the fitting detection pin 6. The shapes of the grooves themselves are similar.

As shown in FIGS. 4 and 5, the front end of the fitting detection pin 6 has formed at the inlet 41 and 43 side with a lock piece 50 and an elasticity imparting groove 52. The lock piece 50 is formed with an engagement projection 54, which engagement projection 54 can engage with a bridge portion 61 shown in FIGS. 2, 6, 7, and 13.

As shown in FIGS. 1 and 4, the rear end of the fitting detection pin 6 (top end in the figures) is formed with a stopper piece 60. Further, at the rear end of the fitting detection pin 6, at the inlet 41 and 43 side, there are formed a pullout preventing lock piece 56 and elasticity imparting groove 58. The pullout preventing lock piece 56 is formed with an engagement projection 59. The engagement projection 59 is able to engage with the bridge portion 57 of FIGS. 2, 6, 7, and 13.

As shown in FIGS. 1 and 2, the periphery of the first housing 2 near the flange 76 is formed with panel fixing lock pieces 62. In this embodiment, the panel fixing lock pieces 62 are formed at the two sides of the insertion slot 22 and at the two sides of the insertion slot 27. These lock pieces 62 are formed with engagement projections 64. The engagement projections 64 are able to engage with an opening of a panel hole 68 of a panel 66 shown in FIGS. 11 to 13.

The outer periphery of the flange 76 of the first housing 2 shown in FIGS. 1 and 2 has attached to it an end ring 74 of a waterproofing grommet 70 shown in FIGS. 10 to 13. The front end seal 72 of the waterproofing grommet 70 is positioned between the flange 76 and engagement projection 64 shown in FIGS. 1 and 2. The grommet 70 covers the outer peripheries of the first lead lines 8 shown in FIGS. 1 and 8 attached to the first housing 2 and ensures their waterproofness. The grommet 70 is formed from elastic material such as a natural rubber and a synthetic rubber.

Next, the method of use of the connector assembly according to the present embodiment will be explained.

Figure 6:
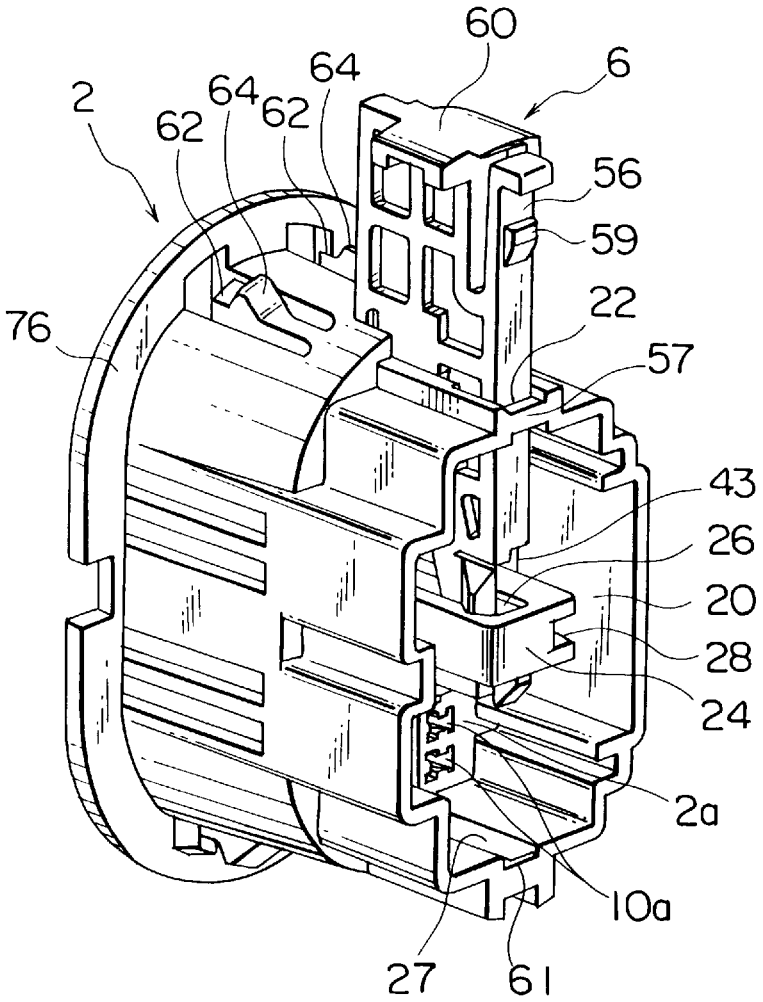
FIG. 6 is a perspective view of the assembly of the fitting detection pin into the first housing.
Figure 7:
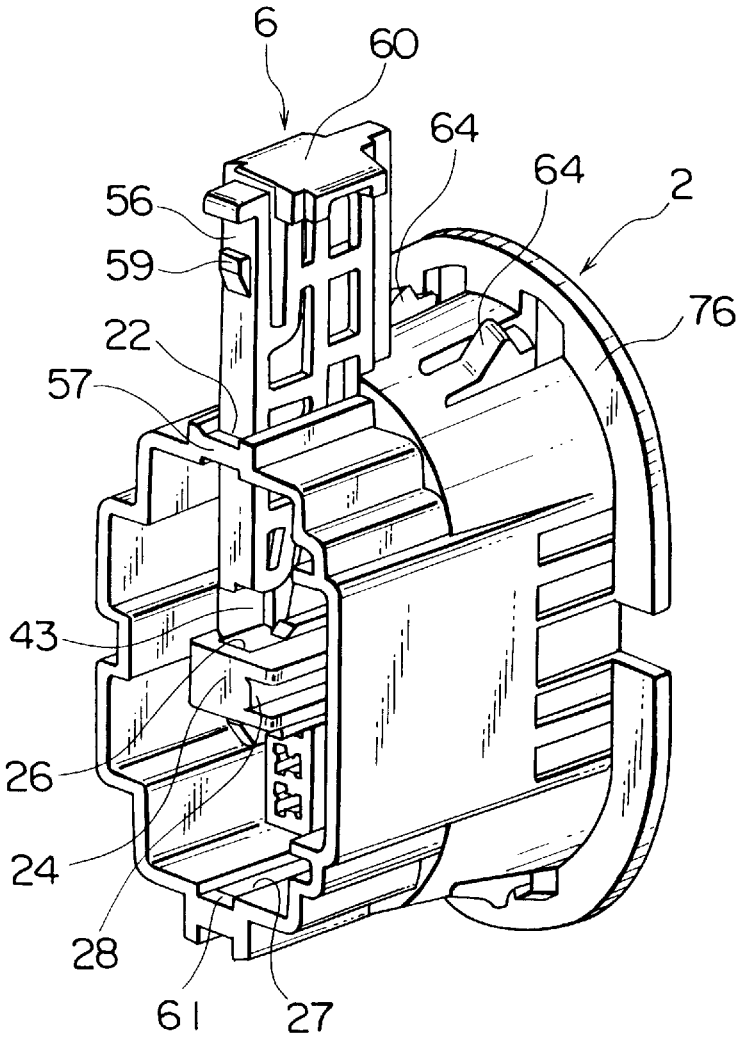
FIG. 7 is a perspective view of the assembly of the fitting detection pin into the first housing.

First, the plate shaped fitting detection pin 6 shown in FIGS. 1 and 4 is temporarily inserted from the detection insertion slot 22 formed in the side of the first housing 2 shown in FIGS. 1 and 2 so as to pass through the approximate center axis of the first housing 2 as shown in FIGS. 6 and 7. In that state, the front end of the second housing 4 is inserted into the fitting opening 20 of the first housing 2.

Figure 9:
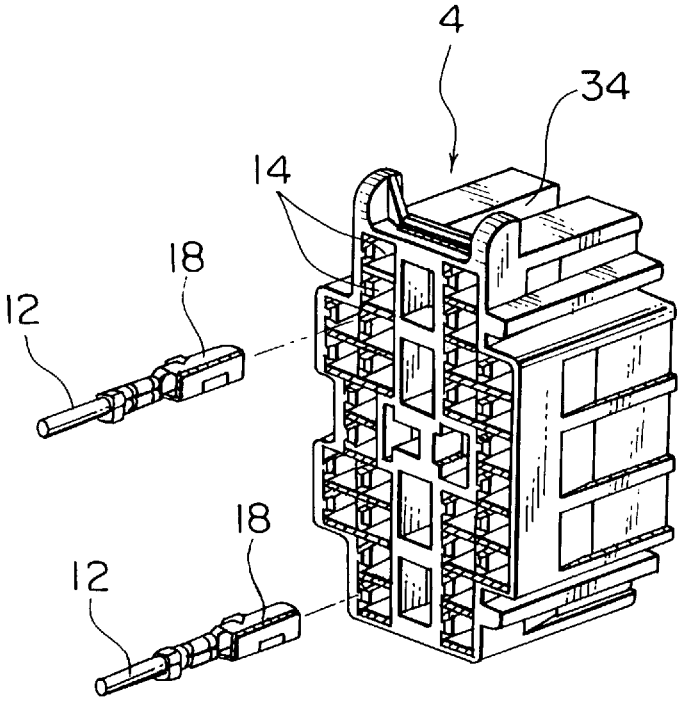
FIG. 9 is a perspective view of the method of attachment of the female terminals to the second housing.

Note that the ends of the lead lines 8 and 12 shown in FIGS. 8 and 9 are attached to the housings 2 and 4. In the embodiment, male terminals 16 are connected to the ends of the lead lines 8 and female terminals 18 are connected to the front ends of the lead lines 12. These are attached in the first and second housings. When the two housings 2 and 4 are normally fitted together, they are connected.

Figure 10:
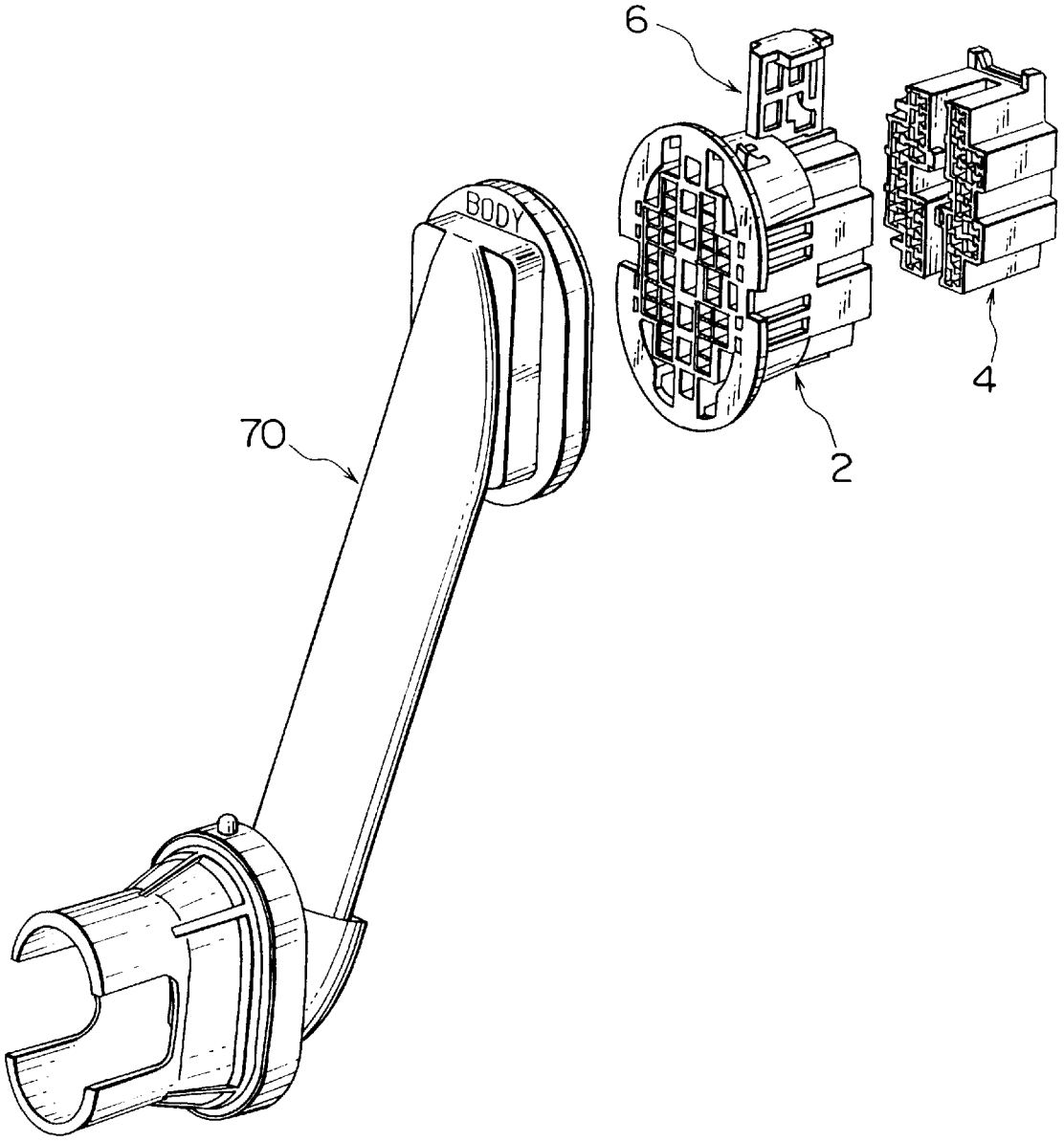
FIG. 10 is a perspective view of the state before the attachment of the waterproofing grommet to the first housing.
Figure 11:
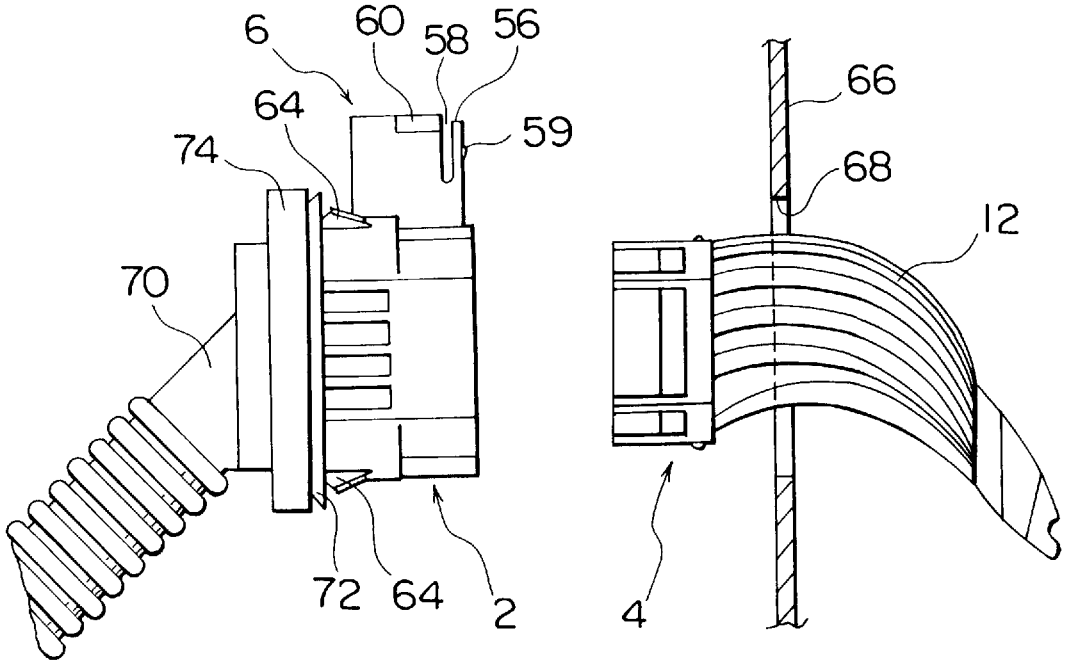
FIG. 11 is a partially sectional side view showing the method of use of the connector assembly shown in FIG. 1.

Further, in the embodiment, as shown in FIGS. 10 and 11, the outer periphery of the flange 76 of the first housing 2 and the outer peripheries of the lead lines 8 are surrounded by the waterproofing grommet 70. In this embodiment, the first housing 2 is positioned at the door side of the vehicle such as the automobile, while the second housing 4 is positioned at the inside of the panel 66 at the body side of the vehicle. The second housing 4 is loosely inserted to the body of the vehicle from the second lead line 12 side of the panel hole 68 of the panel 66.

As shown in FIGS. 12 and 13, the fitting detection pin 6 is fully inserted into the detection insertion slot 22 of the first housing 2 and the guide ribs 36 and 38 formed on the facing inner walls 34*a* and 34*b* of the detection pin recess 34 formed in the second housing 4 shown in FIG. 3 are made to engage with the cam grooves 42 and 46 having the slanted walls 40 and 44 formed in the fitting detection pin 6 shown in FIGS. 4 and 5. The guide ribs 36 and 38 are led into the cam grooves 42 and 46 from the front end inlets 41 and 43 at the two surfaces of the fitting detection pin 6. The engagement between the cam grooves 42 and 46 and the guide pins 36 and 38 is used when pushing the front end of the second housing 4 into the fitting socket 20 of the first housing 2 shown in FIG. 2.

As a result, it is possible to reduce the fitting force between the first housing 2 and the second housing 4.

Further, since the fitting detection pin 6 is inserted from the side so as to pass through the approximate center axis of the connected first housing 2 and second housing 4 and the engagement between the guide pins 36 and 38 and the cam grooves 42 and 46 takes place at the approximate center of the two housings 2 and 4, almost no offset force acts on the two housings 2 and 4. As a result, the two housings 2 and 4 can be fitted well with a low fitting force without occurrence of twisting. Accordingly, even when the number of lead lines (wires) 8 and 12 to be connected to the two housings 2 and 4 is increased, the housings can be fitted well with a small fitting force, a half-fitting (an incomplete fitting) state can be eliminated, and the lead lines can be reliably connected with each other.

Note that when strongly inserting the front end of the second housing 4 into the fitting opening 20 of the first housing 2, sometimes the two housings 2 and 4 will normally fit before the full insertion of the fitting detection pin 6, but there is also a chance of incomplete connection of part of the lead lines. In such a case as well, in the embodiment, the full insertion of the fitting detection pin 6 and the engagement of the guide pins 36 and 38 and the cam grooves 42 and 46 enable the second housing 4 to be pushed into the fitting opening 20 of the first housing 2 in a concentric state, twisting between the two housings 2 and 4 to be corrected, and connection of all of the lead lines 8 and 12 ensured.

Further, from a similar perspective, preferably the fitting opening 20 of the first housing 2 shown in FIG. 2 is formed with the fitting projection 24 projecting out along the approximate center axis and the second housing 4 shown in FIG. 3 is formed with the fitting recess 30 in which the fitting projection 24 fits so as to intersect the detection pin recess 34. This configuration prevents the two housings 2 and 4 from being fitted in an offset state and contributes to a reduction of the fitting force.

In the invention, if the two housings 2 and 4 are not completely fitted, it is not possible to fully insert and push the fitting detection pin 6 into the detection insertion slot 22 of the first housing 2, so it is possible to easily detect a half-fitting (incomplete-fitting) state by observing the fitting detection pin 6 which has not been pushed it. Further, in the half-fitting state, the rear end of the fitting detection pin 6 projects out from the side of the first housing 2, so even if trying to attach the first housing 2 into the panel hole 68 of the panel 66 in this state, the rear end of the fitting detection pin 6 will catch on the panel hole 68 and prevent attachment. Therefore, in the half-fitting state, it is possible to effectively prevent the connector assembly from being attached and affixed to the panel hole 68.

In the embodiment, the waterproofing grommet 70 is attached in advance to outer peripheries of the rear end of the first housing 2 and the first signal lines 8, so, when attaching the first housing 2 to the panel hole 68 of the panel 66, the end seal 72 of the grommet 70 is pushed against the panel wall to create a waterproof construction. To attach the connector assembly to the panel hole 68 of the panel 66, the connector assembly is pushed into the panel hole 68 in the state shown in FIG. 13 and the engagement projections 64 of the lock pieces 62 formed at the outer periphery of the first housing 2 are bent inward. Further, when the connector assembly is pushed into the panel hole 68, the lock pieces 62 return to their original position due to their elasticity and the edge of the opening of the panel hole 68 is gripped with the flange 76 through the engagement projection 64 and the end seal 72.

After the fitting detection pin 6 is fully inserted and the two housings 2 and 4 are normally fitted together, the fitting detection pin 6 engages with the two housings 2 and 4 and prevents pullout. Even if a force acts in a direction detaching the two housings 2 and 4, the correct fitting of the two housings 2 and 4 will not be lost. In the embodiment, the fitting detection pin 6, which prevents pullout, is disposed so as to cross the center of the two housings 2 and 4, so can effectively deal with an axial direction force or offset force in a direction detaching the two housings 2 and 4 and therefore there is no detachment or offset of the regular fitting.

Note that the present invention is not limited to the above embodiment and may be modified in various ways within the scope of the present invention.

Figure 14:
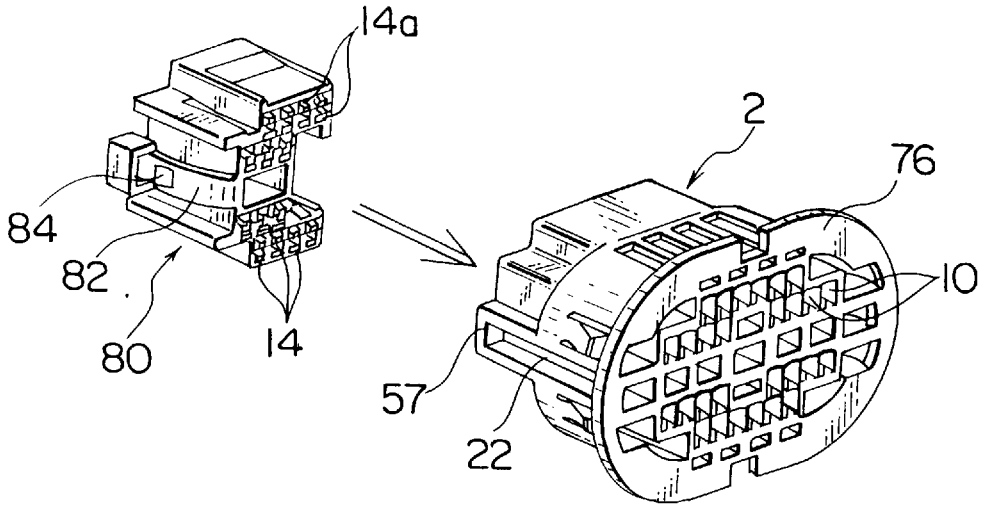
FIG. 14 is a perspective view showing the method of use of the connector assembly according to another embodiment of the present invention.

For example, the number of the lead lines used differs at the driver's side and passenger's side of a vehicle. It is smaller on the passenger's side. Therefore, as shown in FIG. 14, it is possible to configure things so that use is made of a second housing with fewer second terminal attachment holes 14 where lead lines are to be attached (fewer terminals) at the passenger's side and fit this with a first housing 2 the same as with the driver's side.

At the outer periphery of the second housing 80 is attached an elastically deformable manner a lock piece 82 formed with an engagement projection 84. The engagement projection 84 of the lock piece 82 engages with a bridge portion 57 of the first housing in the state where the two housings 2 and 80 are normally fitted with each other.

In this embodiment, it is possible to use two or more second housings with different numbers of terminals for fitting with the same common first housing 2 and thereby possible to connect separately for the driver's side and the passenger's side.

Further, as other modifications, the following are possible.

In the above-mentioned embodiment, the first housing 2 was provided with a plurality of male terminals 16 and the second housing 4 was provided with a plurality of female terminals 18, but the terminals 16 and 18 may be provided vice-versa. Namely, it is possible to provide the first housing 2 with female terminals 18 and the second housing 4 with male terminals 16.

Further, the signal lines are not limited to lead lines 8 and 12 of metal with isolation covers. Optical fibers and other signal lines are also possible.

Further, the guide ribs 36 and 38 formed at the detection pin recess 34 of the second housing 4 shown in FIG. 3 may all be formed singly at just one of the inner walls 34*a* and 34*b*.

The connector assembly according to the present invention is used is not particularly limited, but is preferably automobiles. The assembly is preferably used for connecting signal lines at door panels and other partition walls.

As described above, according to the present invention, it is possible to reduce the fitting force between the first housing and the second housing. Further, since the fitting detection pin is inserted from the side so as to pass through the approximate center axis of the connected first housing and the second housing and the engagement between the guide pins and the cam grooves takes place at the approximate center of the two housings, almost no offset force acts on the two housings. As a result, the two housings can be fitted well with a low fitting force without occurrence of twisting. Accordingly, even when the number of signal lines to be connected to the two housings is increased, the housings can be fitted well with a small fitting force, the half-fitting state can be eliminated, and the signal lines can be reliably connected with each other.

Note that when strongly inserting the front end of the second housing in the fitting opening of the first housing, sometimes the two housings will normally fit before the full insertion of the fitting detection pin, but there is also a chance of incomplete connection of part of the signal lines. In such a case as well, in the present invention, the full insertion of the fitting detection pin and the engagement of the guide pins and the cam grooves enable the second housing to be pushed into the fitting opening of the first housing in a concentric state, twisting between the two housings to be corrected, and connection of all of the signal lines ensured.

In the present invention, if the two housings are not completely fitted, it is not possible to fully insert and push the fitting detection pin into the detection insertion slot of the first housing, so it is possible to detect the incompletely pushed in state. Further, in the half-fitted state, the rear end of the fitting detection pin projects out from the side of the first housing, so in this state even if trying to attach the first housing into the panel hole of the panel, the rear end of the fitting detection pin will catch on the panel hole and prevent attachment. Therefore, it is possible to prevent the connector assembly from being attached and fixed to the panel hole in the half-fitted state.

After the fitting detection pin is fully inserted and the two housings are normally fitted, the fitting detection pin engages with the two housing and prevents their being pulled out. Even if a force acts in a direction detaching the two housings, the regular fitting of the two housings will not be lost. In the present invention, the fitting detection pin, which prevents pullout, is disposed so as to cross the center of the two housings, so can effectively deal with an axial direction force or offset force in a direction detaching the two housings and therefore there is no detachment or offset of the regular fitting.

We claim:

1. A connector assembly comprising:

a first housing in which an end of at least one first signal line is attached, and which has a fitting opening and a detection insertion opening formed at a side;

a second housing in which an end of at least one second line to be connected to the end of said first signal line is attached and which fits into said fitting opening of the first housing; and a plate shaped fitting detection pin which is inserted into said detection insertion opening so as to pass through an approximate center axis of the first housing, said second housing being formed with a detection pin recess which allows the insertion of said fitting detection pin in a state where said second housing is fitted into said fitting opening of said first housing, said detection pin recess comprising facing inner walls, at least one of said inner walls being formed with a projection guide rib, cam grooves formed on opposite sides of said detection pin, said cam grooves having slanted walls constituted so that in a state where said fitting detection pin is inserted into said detection insertion opening, a front end of said projection guide rib engages with said fitting detection pin, such that a force acts in a direction pushing said second housing into said fitting opening of said first housing as said fitting detection pin is inserted into said detection insertion opening, wherein two sides of said detection insertion opening formed at a side of said first housing are formed with panel fixing lock pieces for attaching and affixing said first housing in a panel hole formed in a panel.

2. A connector assembly as set forth in claim 1, wherein two inner walls of said facing inner walls of said second housing constituting said detection pin recess are formed with said projecting guide ribs and two surfaces of said fitting detection pin are formed with said cam grooves having slanted walls each constituted so that in the state where said fitting detection pin is inserted into said detection insertion opening, a front end of said guide rib engages said detection pin and a force acts in a direction pushing said second housing into said fitting opening of said first housing along with the movement in the direction of insertion of said fitting detection pin.

3. A connector assembly as set forth in claim 2, wherein two sides of said detection insertion opening formed at a side of said first housing are formed with panel fixing lock pieces for attaching and affixing said first housing in a panel hole formed in a panel.

4. A connector assembly as set forth in claim 3, wherein the rear end of said fitting detection pin is formed with a pullout preventing lock piece for preventing said fitting detection pin from being pulled out from said detection insertion opening in a state where said fitting detection pin is fully inserted into said detection insertion opening.

5. A connector assembly as set forth in claim 4, wherein said fitting opening of said first housing is formed with a fitting projection which projects out along the approximate center axis, said second housing is formed with a fitting recess which fits with said fitting projection and intersects said detection pin recess, and said fitting projection is formed with a through hole through which said fitting detection pin is inserted.

6. A connector assembly as set forth in claim 1, wherein a rear end of said fitting detection pin is formed with a pullout preventing lock piece for preventing said fitting detection pin from being pulled out from said detection insertion opening in a state where said fitting detection pin is fully inserted into said detection insertion opening.

7. A connector assembly as set forth in claim 6, wherein said fitting opening of said first housing is formed with a fitting projection which projects out along the approximate center axis, said second housing is formed with a fitting recess which fits with said fitting projection and intersects said detection pin recess, and said fitting projection is formed with a through hole through which said fitting detection pin is inserted.

8. A method of attaching a connector assembly, including the steps of:

temporarily inserting a plate shaped fitting detection pin into a detection insertion slot formed at a side of a first housing in which the end of at least one first signal line is attached, wherein said detection pin passes through an approximate center axis of the first housing;

loosely inserting, from a second signal line side of a panel hole formed in a panel, a second housing through said panel hole, wherein the end of at least one second signal line to be connected with the end of said first signal line is attached to said second housing;

inserting at a first signal line side of said panel hole of the panel said second housing into a fitting opening of said first housing in which said fitting detection pin has been temporarily inserted and engaging a guide rib formed on an inner wall facing a detection pin recess formed in said second housing with a cam groove having a slanted wall formed in said fitting detection pin;

inserting said fitting detection pin into said detection insertion opening of said first housing and using the engagement between said cam grooves and said guide pins to push said second housing into said fitting opening of said first housing to prevent insufficient-fitting of said first housing and said second housing; and inserting into said panel hole of said panel of said first housing and said second housing in a state with said fitting detection pin fully inserted for a complete fitting and affixing the outer periphery of said first housing to said panel hole.

9. A method of attaching a connector assembly as set forth in claim 8, wherein panel fixing lock pieces formed on an outer periphery of said first housing are used to affix said first housing to said panel hole of said panel in a detachable manner.

10. A method of attaching a connector assembly as set forth in claim 8, wherein when fully inserting said fitting detection pin into said detection insertion slot of said first housing, a pullout preventing lock piece formed at a rear end of said fitting detection pin is used to fully insert said fitting detection pin in a manner so as to prevent its being pulled out.

11. A method of attaching a connector assembly as set forth in claim 10, wherein a waterproofing grommet is attached in advance to the outer periphery of the rear end of said first housing and said first signal lines and, when attaching said first housing to said panel hole of said panel, an end of said grommet is pushed against the panel wall to create a waterproof construction.

* * * * *